United States Patent [19]

Sakamaki et al.

[11] Patent Number: 4,898,526

[45] Date of Patent: Feb. 6, 1990

[54] VANE PUMP WITH AXIAL INLET AND PERIPHERAL TANGENTIAL OUTLET

[75] Inventors: Hiroshi Sakamaki; Yukio Horikoshi; Takeshi Jinnouchi, all of Sakado, Japan

[73] Assignee: Eagle Industry Co., Ltd., Tokyo, Japan

[21] Appl. No.: 314,296

[22] Filed: Feb. 22, 1989

Related U.S. Application Data

[63] Continuation-in-part of Ser. No. 78,422, Jul. 27, 1987, abandoned.

[30] Foreign Application Priority Data

Aug. 12, 1986 [JP] Japan ..... 61-122850[U]

[51] Int. Cl.[4] ..... F04C 2/344

[52] U.S. Cl. ..... 418/257; 418/259

[58] Field of Search ..... 418/253-270; 415/206

[56] References Cited

U.S. PATENT DOCUMENTS

| | | | |
|---|---|---|---|
| 2,677,330 | 5/1954 | Rosaen | 418/268 |
| 2,982,224 | 5/1961 | Williams | 418/268 |
| 3,011,449 | 12/1961 | Ernst | 418/269 |
| 3,084,677 | 4/1963 | Mitchell | 418/265 |
| 3,398,644 | 8/1968 | Wetzel | 418/269 |
| 3,762,375 | 10/1973 | Bentley | 418/268 |
| 3,917,438 | 11/1975 | Glanvall | 418/259 |
| 4,561,834 | 12/1985 | Poss | 418/255 |

*Primary Examiner*—John J. Vrablik

*Attorney, Agent, or Firm*—Jordan & Hamburg

[57] ABSTRACT

A vane pump comprising an intake port for sucking air into the pump, the intake port being extended axially with respect to a housing having an approximately cylindrical shape, and an outlet port for discharging air, the outlet port being extended from the peripheral wall of the housing toward the outer periphery, so as to make a flow of air smooth.

2 Claims, 3 Drawing Sheets

VANE PUMP WITH AXIAL INLET AND PERIPHERAL TANGENTIAL OUTLET

This application is a continuation-in-part, of application Ser. No. 078,422, filed July 27, 1987, abandoned.

BACKGROUND OF THE INVENTION

The present invention relates to an improvement in a vane pump which is used for a supercharger, a compressor, and the like.

A vane pump schematically shown in FIG. 5 has been heretofore widely known.

In FIG. 5, reference numeral 31 designates a housing; 32, a rotor inserted eccentrically into an inner peripheral space of the housing 31 and rotatably supported by a rotational shaft 33; 35*a*, 35*b* and 35*c*, plate-like vanes disposed radially retractably from vane grooves 34*a*, 34*b* and 34*c* equally spaced apart so as to peripherally divide the outer peripheral side of the rotor 32 into three sections. When the rotor 32 is rotated in the direction as indicated by the arrow X by the rotational shaft 33, the vanes 35*a*, 35*b* and 35*c* are moved out in the direction of the outside diameter by the centrifugal force, and the end edges thereof rotate while slidably contacting the inner peripheral surface of the housing 31. Since the rotor 32 is eccentric with respect to the housing 31 as previously mentioned, as such rotation occurs, volumes of working spaces 36*a*, 36*b* and 36*c* defined by the housing 31, the rotor 32 and the vanes 35*a*, 35*b* and 35*c* are repeatedly enlarged and contracted. In the figure, the working space 36*a* gradually enlarges its volume s the rotor rotates to suck therein a fluid from an intake port 37 axially bored; the working space 36*c* gradually contracts its volume as the rotor rotates to discharge a fluid to an outlet port 38 bored axially thereto. It is known that the intake port 37 and outlet port 38 are designed so that both the ports axially extend from the side wall of the housing 31 as shown, and that they extend externally from the peripheral wall of the housing 31.

However, in the above-described conventional example, the fluid having been sucked axially from the intake port 37 rotatively flows along the inner peripheral surface of the housing 31 within the pump and again changes its direction of flow into the axial flow at the outlet port 38. therefore, the kinetic energy, specifically the inertia of the fluid obtained by the rotation of the vanes 35*a*, 35*b* and 35*c* does not effectively act in the discharge direction. Also, n the case where both the intake port 37 and outlet port 38 are extended externally from the peripheral wall of the housing 31, the centrifugal force effectively acts during the stage of the discharge whereas the centrifugal force functions as resistance by which the suction force is attenuated. Accordingly, it is difficult to accelerate the flow of fluid. An amount of leakage of fluid from the working space 36*a* to 36*c*, from 36*b* to 36*a*, and from 36*c* to 36*b* between the vanes 35*a*, 35*b* and 35*b* and the housing 31 increases, which unavoidably deteriorates the efficiency of volume.

SUMMARY OF THE INVENTION

It is an object of the present invention to overcome the hydrodynamics loss as described above to enhance the efficiency of the pump.

For solving the aforementioned problems, a vane pump according to the present invention comprises an intake port which is open to a portion in which a volume of a working space defined between vanes enlarges as rotation takes place, said intake port being extended axially with respect to a housing, and an outlet port which is open to a portion in which the volume of said working space contracts as rotation takes place, said outlet port being extended externally from the peripheral wall of the housing.

According to the arrangement of the present invention, since the outlet port is extended from the peripheral wall of the housing toward the outer periphery, the inertia motion of the fluid forced out of the outlet port by the vanes exhibits the action of increasing the discharge force, and the siphon effect resulting therefrom promotes the self-suction at the back of the vane; whereas since the intake port is extended axially of the housing on which the centrifugal force does not act as the resistance for impeding the suction, the flow of fluid within the pump is accelerated.

As will be apparent from the above-described explanation, in the vane pump according to the present invention, the intake port which is open to the portion in which the volume of the working space defined between the vanes enlarges as rotation takes place is extended axially with respect to the housing, whereby the suction can be carried out smoothly without subjecting to the resistance resulting from the centrifugal force; and the outlet port which is open to the portion in which the volume of the working space contracts as rotation takes place is extended from the peripheral wall of the housing toward the outer periphery, whereby the inertia of the fluid acts so as to increase the discharge force, and the self-suction is promoted as the discharge force increases so as to accelerate the flow of the fluid. The present invention exhibits the excellent effect in that the volume efficiency of the pump increases by 5 to 10% as compared with to the vane pump having the conventional construction in which both the intake port and outlet port are axially extended, or both said ports are extended from the peripheral wall of the housing to the outside.

While the present invention has been briefly outlined, the above and other objects and new features of the present invention will be fully understood from the reading of the ensuing detailed description in conjunction with embodiments shown in the accompanying drawings. It is to be noted that the drawings are exclusively used to show one embodiment for the understanding of the present invention and are not intended to limit the scope of this invention.

DESCRIPTION OF THE PREFERRED EMBODIMENTS

Figure 1:
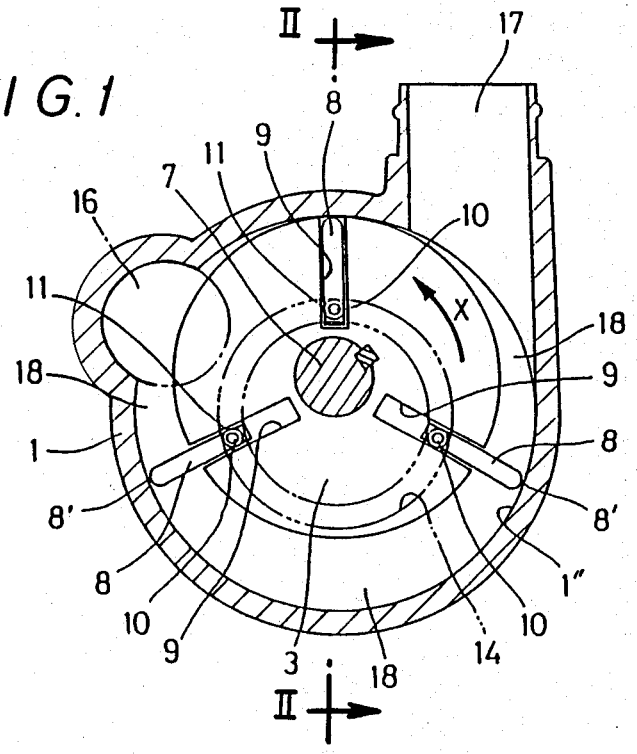
FIG. 1 is a sectional view of a vane pump according to an embodiment of the present invention taken along the line I—I in FIG. 3.
Figure 2:
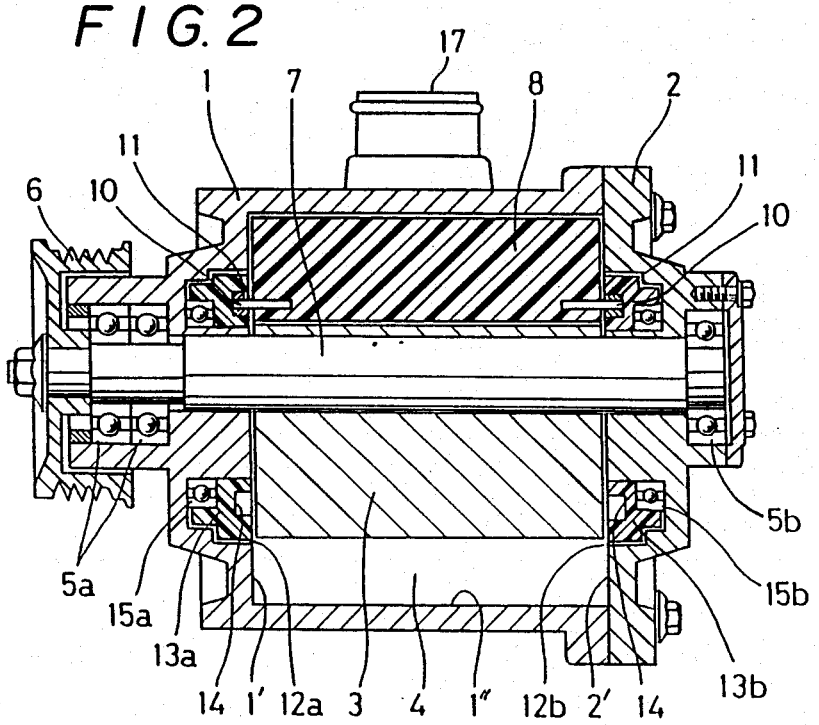
FIG. 2 is a sectional view taken along the line II—II in FIG. 1.
Figure 3:
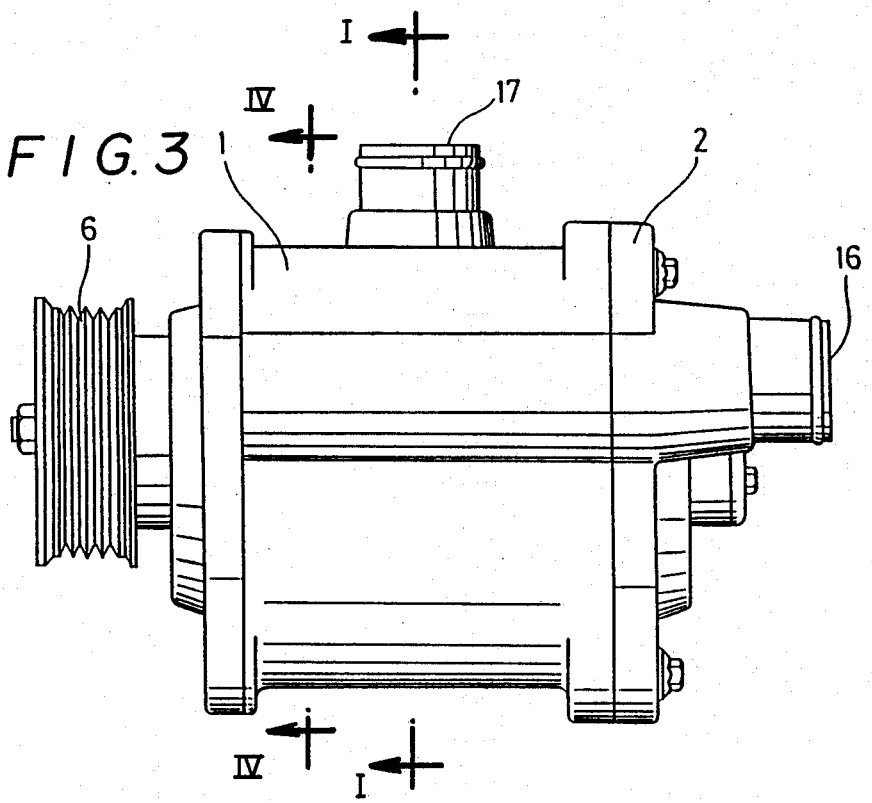
FIG. 3 is a side view of the vane pump.
Figure 5:
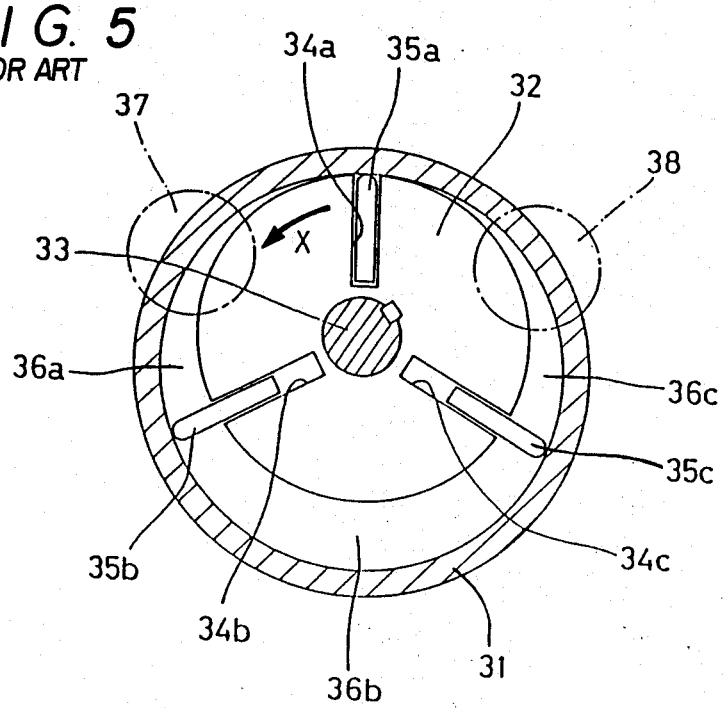
FIG. 5 PRIOR ART
FIG. 5 is a sectional view showing one example of a conventional vane pump.
Figure 4:
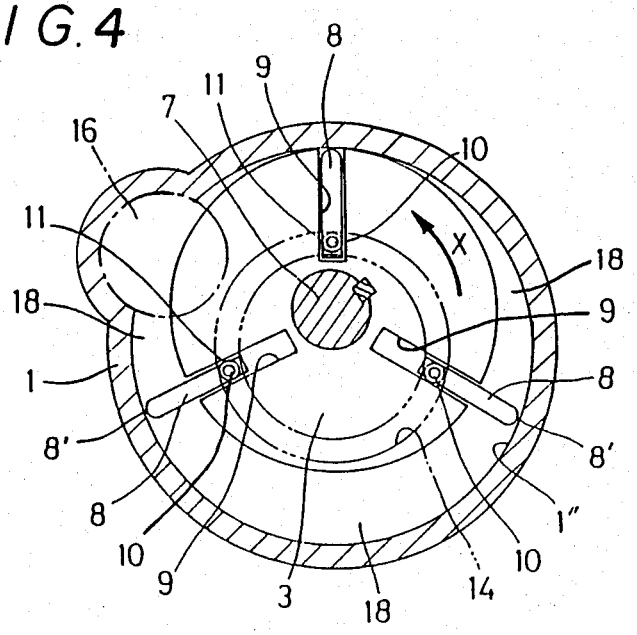
FIG. 4 is a sectional view taken along the line IV—IV in FIG. 3.

An embodiment of a vane pump according to the present invention will now be described with reference to FIGS. 1 to 4.

In FIGS. 1 to 4, a front housing 1 and a rear housing 2, which both housings are made of non-ferrous metal such as aluminum which is light in weight and is small in the coefficient of thermal expansion, are secured integral with each other. A rotor 3 made of iron eccentrically inserted into an inner peripheral space 4 of the housing surrounded by both the housings 1 and 2 is extended through both the housings 1 and 2 through ball bearings 5*a* and 5*b* and rotatably mounted on a rotational shaft 7 to which a drive force is transmitted from a pulley 6. Plate-like vanes 8 principally made of a carbon material having an excellent slidability are disposed to be projected and retracted (slidably) in vane grooves 9, respectively, which are formed in the form of a depression in an equally spaced apart so as to peripherally divide the outer peripheral side of the rotor 3 into three sections, on the rotor 3. Pins 10 and 10 made of steel are projected on both ends of each of the vanes 8, and a sleeve bearing 11 made of resin having excellent slidability and abrasion resistance is slipped over each of the pins 10. In annular recesses 12*a* and 12*b* formed in inner surfaces 1' and 2' where the front housing 1 and the rear housing 2 are opposed to each other in coaxial with the inner peripheral space 4 of the housing (in coaxial with an inner peripheral surface 1" of the front housing 1), retainer rings 13*a* and 13*b* made of non-ferrous metal such as aluminum and each having an annular race 14 are rotatably fitted through ball bearings 15*a* and 15*b* respectively. The pins 10 and 10 projected on the respective vanes 8 peripherally slidably engage the annular races 14 and 14 through the respective sleeve bearings 11. This engagement defines the radial movement of the vanes 8 during rotation so as to maintain a state in which there is formed a slight clearance between the end edge 8' thereof and the inner peripheral surface 1" of the front housing 1. An intake port 16 is open to a portion in which a volume of the working spaces 18 defined between the vanes 8 enlarges as rotation takes place is extended axially from the side wall of the rear housing 2, and an outlet port 17 which is open to a portion in which a volume of the working spaces 18 contracts as rotation takes place is extended from the peripheral wall of the front housing 1 to the outer peripheral side, more specifically, extended approximately in the tangential direction which is the direction approximately in coincidence with the direction of inertia in which the fluid thrown by the vanes 8.

When the rotational shaft 7 and the rotor 3 are rotated in the direction as indicated by the arrow X by virtue of the drive force from the pulley 6, the vanes 8 also rotate, and the pins 10 and 10 projected on the vanes 8, respectively, and the sleeve bearings 11 and 11 slipped over the pins 10 and 10 rotate along the annular races 14 and 14. Since the inner peripheral surface 1' of the housing and the annular race 14 are in the coaxial relation and the annular race 14 and the rotor 3 are in the eccentric relation, the vanes 8 are radially slidably moved in the vane grooves 9 of the rotor 3 to be projected and retracted repeatedly with the result that the volumes of the working spaces 18 defined between the vanes 8 repeatedly increase and decrease, as the rotation takes place. This working space 18 sucks fluid from the intake port 16 in the process wherein the volume thereof enlarges as rotation takes place, and allows fluid to be discharged out of the outlet port 17 in the process in which the volume thereof contracts as rotation takes places. As previously mentioned, the direction of the outlet port 17 is approximately in coincidence with the direction of inertia of the fluid, and therefore, the discharge force enhances to provide extremely smooth discharge. On the other hand, the intake port 16 is extended axially of the side wall of the rear housing 2, and therefore, the centrifugal force resulting from the rotation of fluid within the inner peripheral space 4 of the housing will not be affected as the resistance against the suction, and the self-suction action at the back of the vanes 8 is promoted by the siphon effect resulting from the enhancement of the discharge force. Accordingly, the loss caused by the leakage can be eliminated, and the flow of fluid is accelerated.

The rear housing 2 is designated as one housing end section and the lefthand end part of front housing 1 (as appearing in FIGS. 2 and 3) is designated as another housing end section. The section of the front housing 1 between these two housing end sections is designated an intermediate housing section. The intake port 16 is designated as an axial inlet means and extends the axial length of such intermediate housing section from the aforementioned one housing end section to the aforementioned other housing end section.

As described above, according to the present embodiment, the hydrodynamics loss is overcome. In addition, since it is designed so that the vanes 8 rotate in non-contact with the inner peripheral surface 1" of the housing 1, the loss caused by the mechanical friction is also extremely reduced, and the very high efficiency may be obtained.

While we have described the preferred embodiment of the present invention, it will be obvious that various other modifications can be made without departing the principle of the present invention. Accordingly, it is desired that all the modifications that may substantially obtain the effect of the present invention through the use of the structure substantially identical with or corresponding to the present invention are included in the scope of the present invention by the appended claim.

What is claimed is:

1. A vane pump comprising a pump housing means, said housing means having an internal cylindrical working chamber, a rotor means rotatably mounted in said working chamber, said working chamber having an inner peripheral wall and a cylindrical axis, said rotor means having an axis of rotation which is spaced from said cylindrical axis such that said rotor means is eccentrically mounted in said cylindrical working chamber, said housing means having two end sections and an intermediate section, said end sections being disposed at the longitudinal ends of said cylindrical working chamber, said intermediate section connecting said two end sections and being disposed radially outwardly of said working chamber, said end sections having bearing means for rotatably supporting said rotor means, said rotor means having a plurality of generally radial slots, vane elements slidably mounted in said slots such that as said rotor means rotates, said vane elements slide in and out of said slots to provide variable volume chambers between said vane elements which effect a pumping action, said variable volume chambers having an outer periphery defined by said inner peripheral wall of said cylindrical working chamber, said variable volume chambers having longitudinal ends defined by said two housing end sections, one of said housing end sections and said intermediate housing section having an axial inlet means which extends in an axial direction parallel to said cylindrical axis and which opens onto said working chambers, said axial inlet means extending the axial length of said intermediate housing section from said one housing end section to the other housing end section, said axial inlet means being spaced radially outwardly of the axis of rotation of said rotor means, said intermediate housing section having an outlet means which opens up onto said outer periphery of said working chambers such that the fluid being pumped is discharged through the outer periphery of the working chambers into said outlet means, said outlet means having an outlet passage which is tangentially disposed relative to said cylindrical chamber such that the fluid being pumped flows from said variable volume chambers tangentially into said tangential passage coincident with the inertia imparted to the fluid by the pump as said fluid exits said variable volume chambers.

2. A vane pump according to claim 1, wherein said outlet means further comprises a discharge conduit which is disposed generally midway between the longitudinal ends of said cylindrical working chamber.

* * * * *